US007137752B2

(12) United States Patent
Hendee

(10) Patent No.: US 7,137,752 B2
(45) Date of Patent: Nov. 21, 2006

(54) ORGANIZER COVER WITH EXTERNAL CONCEALMENT FLAPS

(75) Inventor: Benton E. Hendee, Unadilla, NY (US)

(73) Assignee: MeadWestvaco Corporation, Stamford, CT (US)

( * ) Notice: Subject to any disclaimer, the term of this patent is extended or adjusted under 35 U.S.C. 154(b) by 347 days.

(21) Appl. No.: 10/776,023

(22) Filed: Feb. 10, 2004

(65) Prior Publication Data

US 2004/0218967 A1 Nov. 4, 2004

Related U.S. Application Data

(63) Continuation-in-part of application No. 29/175,466, filed on Feb. 5, 2003, now Pat. No. Des. 486,516.

(51) Int. Cl.
*B42F 13/00* (2006.01)

(52) U.S. Cl. ..... 402/73; 281/31; 206/214; 150/112

(58) Field of Classification Search ..... 281/21.1, 281/29, 31, 34, 51, DIG. 1; 402/503, 73; 150/112, 103, 118, 114, 108; 206/214–215, 206/224, 371, 472; D19/26–34
See application file for complete search history.

(56) References Cited

U.S. PATENT DOCUMENTS

| | | | | | |
|---|---|---|---|---|---|
| 352,358 | A | * | 11/1886 | Scherer | 312/231 |
| 2,333,523 | A | | 11/1943 | Cohun | 281/16 |
| 2,612,199 | A | * | 9/1952 | Schocket | 150/112 |
| 2,798,524 | A | * | 7/1957 | Ryon | 150/103 |
| 3,182,701 | A | * | 5/1965 | Ginsburg | 150/105 |
| 4,027,710 | A | * | 6/1977 | Keebler | 150/103 |
| 4,050,493 | A | * | 9/1977 | Cho | 150/106 |
| 4,068,786 | A | * | 1/1978 | Taniguchi | 224/577 |
| 4,192,365 | A | | 3/1980 | Siegel | 150/35 |
| 4,630,843 | A | * | 12/1986 | Willat | 281/30 |
| 4,687,036 | A | | 8/1987 | Thomas | 150/118 |
| 4,739,809 | A | | 4/1988 | Adams | 150/112 |
| 5,160,001 | A | * | 11/1992 | Marceau | 190/102 |
| 5,348,347 | A | * | 9/1994 | Shink | 281/31 |
| D359,310 | S | * | 6/1995 | Su | D19/90 |
| 5,489,021 | A | | 2/1996 | Wallingford | 206/214 |
| 5,713,616 | A | | 2/1998 | Knudson | 294/1.3 |
| 5,725,039 | A | * | 3/1998 | Macinai et al. | 150/104 |
| 5,911,262 | A | | 6/1999 | Steinhart | 150/103 |

(Continued)

OTHER PUBLICATIONS

Fossil organizer outdoor unit, photocopy 4 pages.

(Continued)

*Primary Examiner*—Monica Carter
*Assistant Examiner*—J Williams
(74) *Attorney, Agent, or Firm*—Lawrence P. Trapani

(57) ABSTRACT

An organizer cover, comprising first and second cover panels and a spine, an external surface, at least one organizer element, and at least one concealment flap. The spine is operatively coupled between the first and second cover panels. The first and second cover panels and the spine each have an exterior. The external surface includes the exteriors of the first and second cover panels and of the spine. The organizer element is located on the external surface of the cover. The concealment flap is connected to the external surface and manually positionable between a closed position against the external surface and an open position. The concealment flap is located and configured to conceal, at least in part, the organizer element when the flap is in the closed position. Neither the external surface nor the organizer element includes thereon any means for securing the concealment flap in the closed position.

11 Claims, 4 Drawing Sheets

U.S. PATENT DOCUMENTS

| | | | | |
|---|---|---|---|---|
| 6,017,062 | A * | 1/2000 | White | 281/29 |
| 6,047,752 | A | 4/2000 | Southwick | 150/117 |
| D424,615 | S * | 5/2000 | Wyant | D19/32 |
| 6,126,012 | A | 10/2000 | Roegner | 206/579 |
| 6,161,979 | A | 12/2000 | Yamamoto et al. | 402/73 |
| 6,213,670 | B1 * | 4/2001 | Wien | 402/73 |
| 6,250,834 | B1 * | 6/2001 | Wien | 402/73 |
| 6,283,183 | B1 | 9/2001 | Cooper | 150/112 |
| 6,394,497 | B1 * | 5/2002 | Ho | 281/29 |
| 6,739,784 | B1 * | 5/2004 | Tims et al. | 402/73 |
| 6,767,152 | B1 * | 7/2004 | Wehmeyer et al. | 402/73 |
| 2001/0027834 | A1 * | 10/2001 | Southwick | 150/108 |
| 2004/0099496 | A1 * | 5/2004 | Hollingsworth | 190/111 |

OTHER PUBLICATIONS

Xhilaration handbag, photocopy 3 pages.

* cited by examiner

ORGANIZER COVER WITH EXTERNAL CONCEALMENT FLAPS

CROSS-REFERENCE TO RELATED APPLICATIONS

This application is a continuation-in-part of application Ser. No. 29/175,466, filed Feb. 5, 2003 now U.S. Pat. No. D,486,516.

BACKGROUND OF THE INVENTION

1. Technical Field

The present invention relates generally to calendars, planners and organizers, and more particularly to covers or jackets for housing such items.

2. Background Art

External covers have been used to house, for example, organizers, diaries or planners. Such covers are useful to protect and conceal the contents of the organizer, diary, or planner. Many of such covers are equipped with a closure mechanism such as, for example, a zipper or a fold-over flap secured by a snap, clasp or magnet. An example of such a cover is shown and described in U.S. Pat. No. 6,161,979 to Yamamoto et al. While such covers have proven useful, they can be inconvenient when quick and easy access to the cover's internal contents is necessary or desired.

In order to overcome this inconvenience, certain frequently used functions of the organizer, planner, diary, etc., have been relocated to the outside of the cover, for easy access. Examples of such relocation are shown and described in U.S. Pat. No. 6,283,183 to Cooper, U.S. Pat. No. 6,161,979 to Yamamoto et al., U.S. Pat. No. 6,126,012 to Roegner, U.S. Pat. No. 6,047,752 to Southwick, U.S. Pat. No. 5,911,262 to Steinhart, U.S. Pat. No. 5,489,021 to Wallingford, U.S. Pat. No. 4,739,809 to Adams, and U.S. Pat. No. 4,192,365 to Siegel.

The relocation of various organizer functions to the outside of the cover sometimes raises aesthetics issues. The implementation of such functions on the outside of the cover can be unsightly. One approach to improving the aesthetics of such covers is to hide the externally located functions behind a flap or flaps. Examples of such external flaps are shown in U.S. Pat. No. 6,283,183 to Cooper (at FIG. 1), U.S. Pat. No. 6,161,979 to Yamamoto et al. (at FIG. 18), U.S. Pat. No. 6,126,012 to Roegner (at FIGS. 3 and 4), U.S. Pat. No. 6,047,752 to Southwick (at FIG. 4), U.S. Pat. No. 5,911,262 to Steinhart (at FIGS. 4 and 5), U.S. Pat. No. 5,489,021 to Wallingford (at FIG. 4), and U.S. Pat. No. 4,739,809 to Adams (at FIG. 3).

In all such examples, some visible and present means for securing the flap to the outside cover is shown. Snaps are used in the patents to Cooper and Adams; buckles are used in Yamamoto et al.; hook and loop fasteners are used in Wallingford and Roegner; and zippers are used in Steinhart and Southwick. Such visible and present securing means can also be unsightly, or at least undesirable when inconspicuous concealment of organizer functions is the goal.

Moreover, such securing means may interfere with the organizer function or adversely affect the aesthetics of the layout of the function or functions. This is especially of concern with compact cover designs, where the surface area for the function(s) and securing means is limited. This concern is illustrated to some degree in U.S. Pat. No. 6,126,012 to Roegner (at FIG. 4) and U.S. Pat. No. 5,489,021 to Wallingford (at FIG. 4), where hook and loop fasteners are prominently displayed on the outside surface of the cover and/or on the inside of the flap. Such securing means occupy substantial surface area otherwise available for relocated functions. In addition, such securing means significantly influence the aesthetics of the article.

OBJECTS AND SUMMARY OF THE INVENTION

It is therefore an object of the present invention to provide an organizer cover that avoids the aforesaid limits and problems associated with the prior art.

It is another object of the present invention to provide an organizer cover having an external flap that conceals, at least in part, an organizer function relocated to the outside surface of the cover (a "concealment flap").

It is a further object of the present invention to provide an organizer cover, with organizer functions relocated to the outside surface, that is more aesthetically pleasing than the prior art covers.

It is yet another object of the present invention to provide an organizer cover having a concealment flap that does not interfere with an organizer function relocated to the outside surface of the cover.

It is yet a further object of the present invention to provide an organizer cover having at least one concealment flap, where neither the flap, the outside surface of the cover, nor the organizer function itself contains thereon a means for securing the flap to the cover.

These and other objects are attained in accordance with the present invention wherein there is provided an organizer cover comprising first and second cover panels and a spine, an external surface, at least one organizer element, and at least one concealment flap. The spine is operatively coupled between the first and second cover panels. The first and second cover panels and the spine each have an exterior. The external surface includes the exteriors of the first and second cover panels and of the spine. The organizer element is located on the external surface of the cover. The concealment flap is connected to the external surface and manually positionable between a closed position against the external surface and an open position.

The concealment flap is located and configured to conceal, at least in part, the organizer element when the flap is in the closed position. Neither the external surface nor the organizer element includes thereon any means for securing the concealment flap in the closed position.

In a preferred embodiment, the concealment flap may be secured in the closed position by means of magnetic elements hidden below the external surface of the organizer cover and below an interior surface of the flap.

BRIEF DESCRIPTION OF THE DRAWING

Further objects of the present invention will become apparent from the following description of the preferred embodiment with reference to the accompanying drawing, in which.

DESCRIPTION OF THE PREFERRED EMBODIMENT

Figure 1:
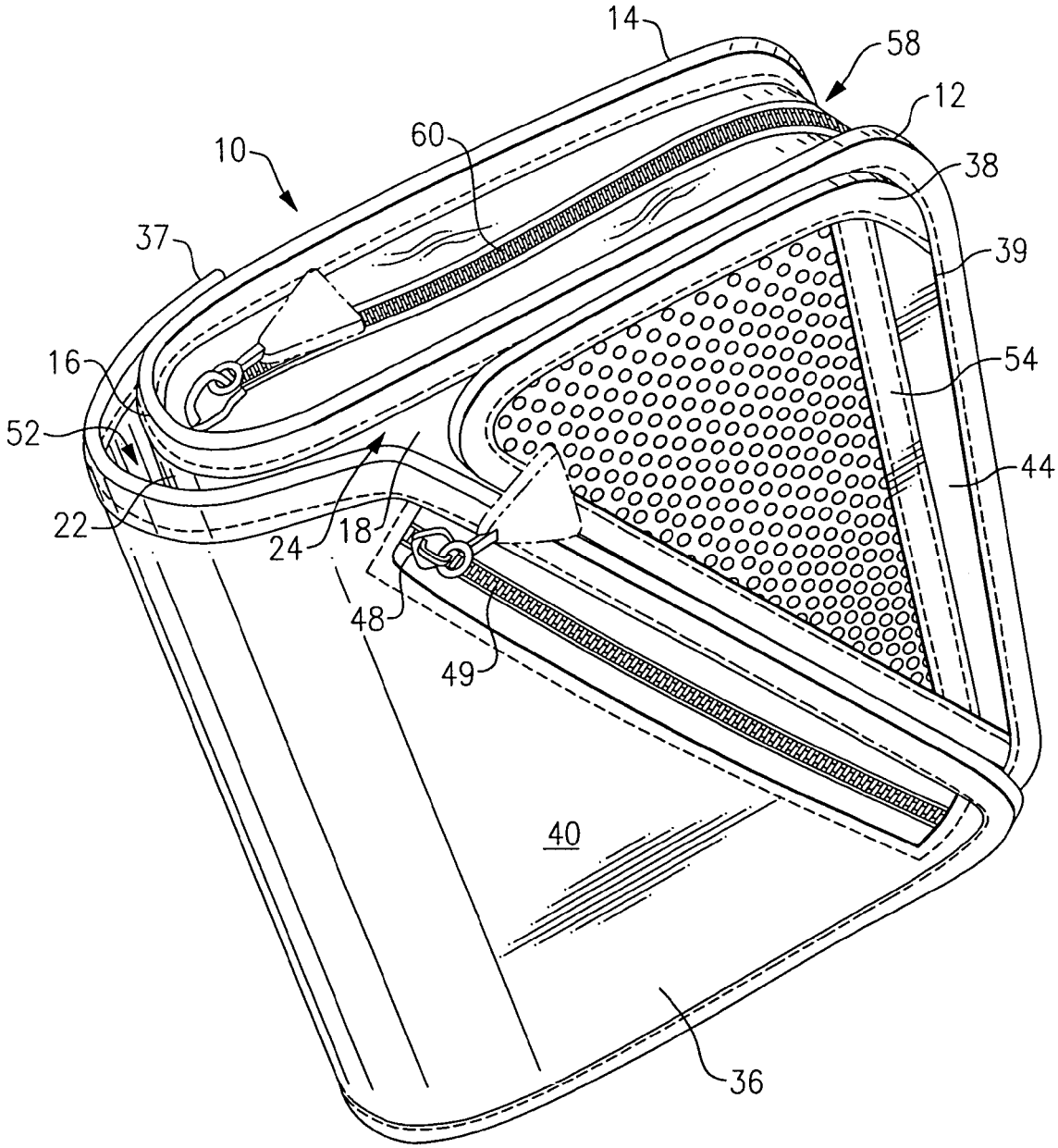
FIG. 1 is a perspective view of an organizer cover of the present invention, shown with an organizer enclosed.
Figure 2:
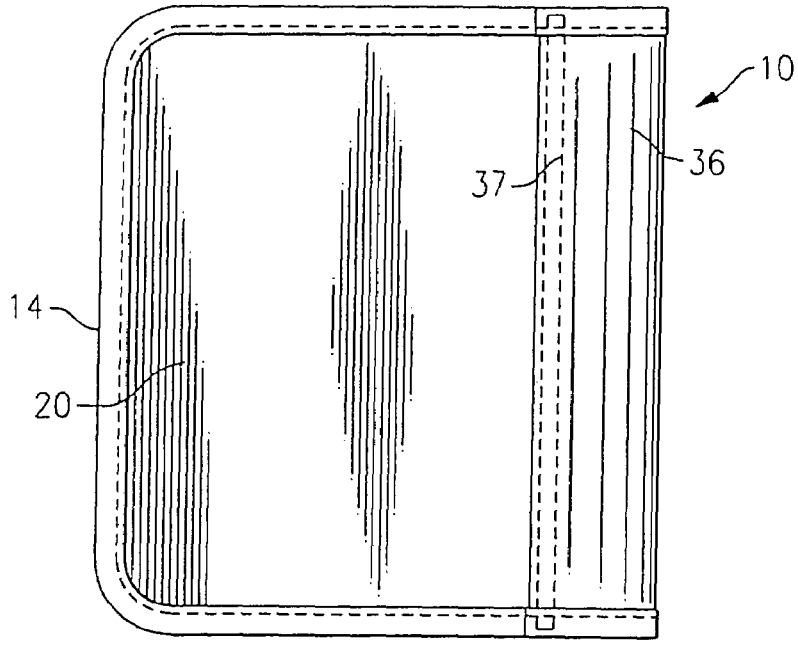
FIG. 2 is a rear elevation view of the organizer cover of FIG. 1.
Figure 3:
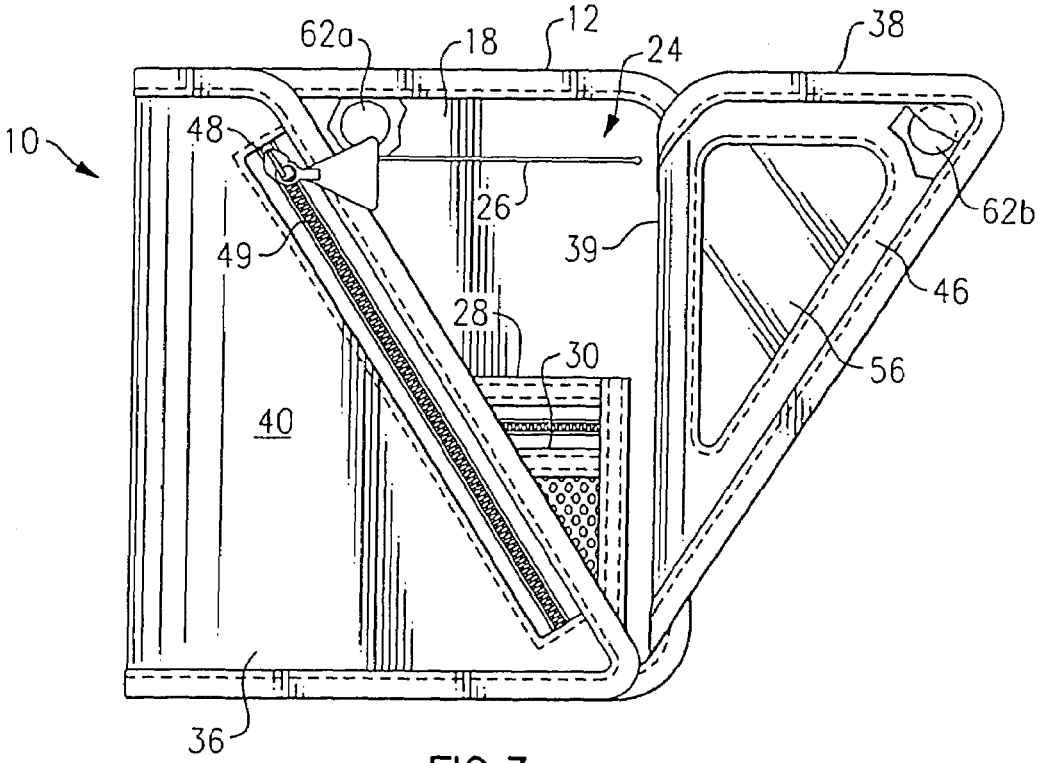
FIG. 3 is a front elevation view of the organizer cover of FIG. 1, shown with a first concealment flap in a closed position and a second concealment flap in an open position.
Figure 4:
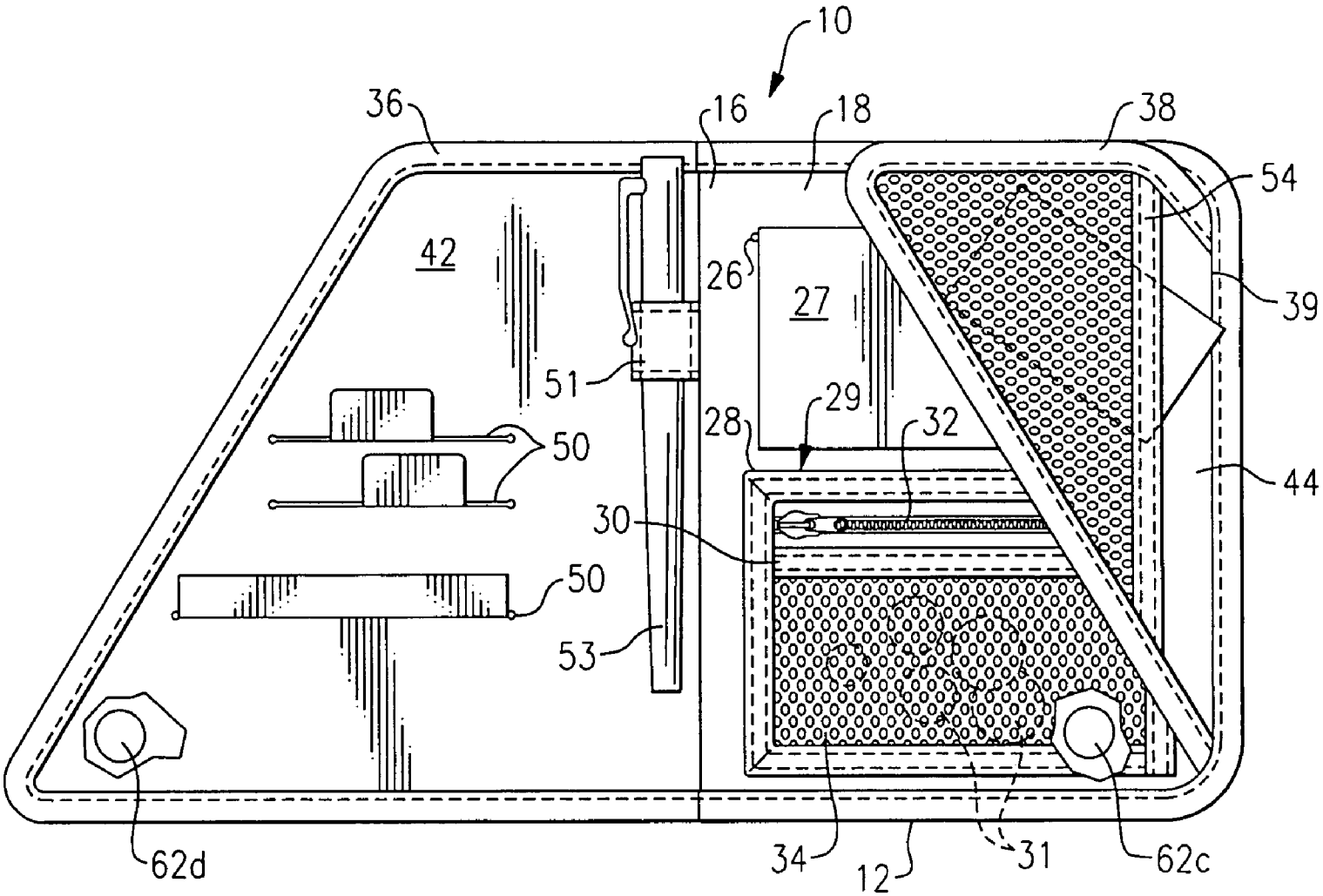
FIG. 4 is a front elevation view of the organizer cover of FIG. 1, shown with the first flap in an open position and the second flap in a closed position.

Referring now to FIGS. 1–5, there is shown a preferred embodiment of the present invention. An organizer cover 10 includes a front cover panel 12 and a rear cover panel 14. A spine 16 is operatively coupled between panels 12, 14. As shown in FIGS. 1 and 4, spine 16 is integrally formed with front and rear panels 12, 14. Panels 12 and 14 each have an exterior surface 18 and 20, respectively. Likewise, spine 16 has an exterior surface 22. Organizer cover 10 has an overall external surface 24 which, in the embodiment of FIGS. 1–5, includes the individual exterior surfaces 18, 20 and 22. Except as noted below, the construction of cover 10 is conventional and well known, and thus will not be described in detail.

Figure 5:
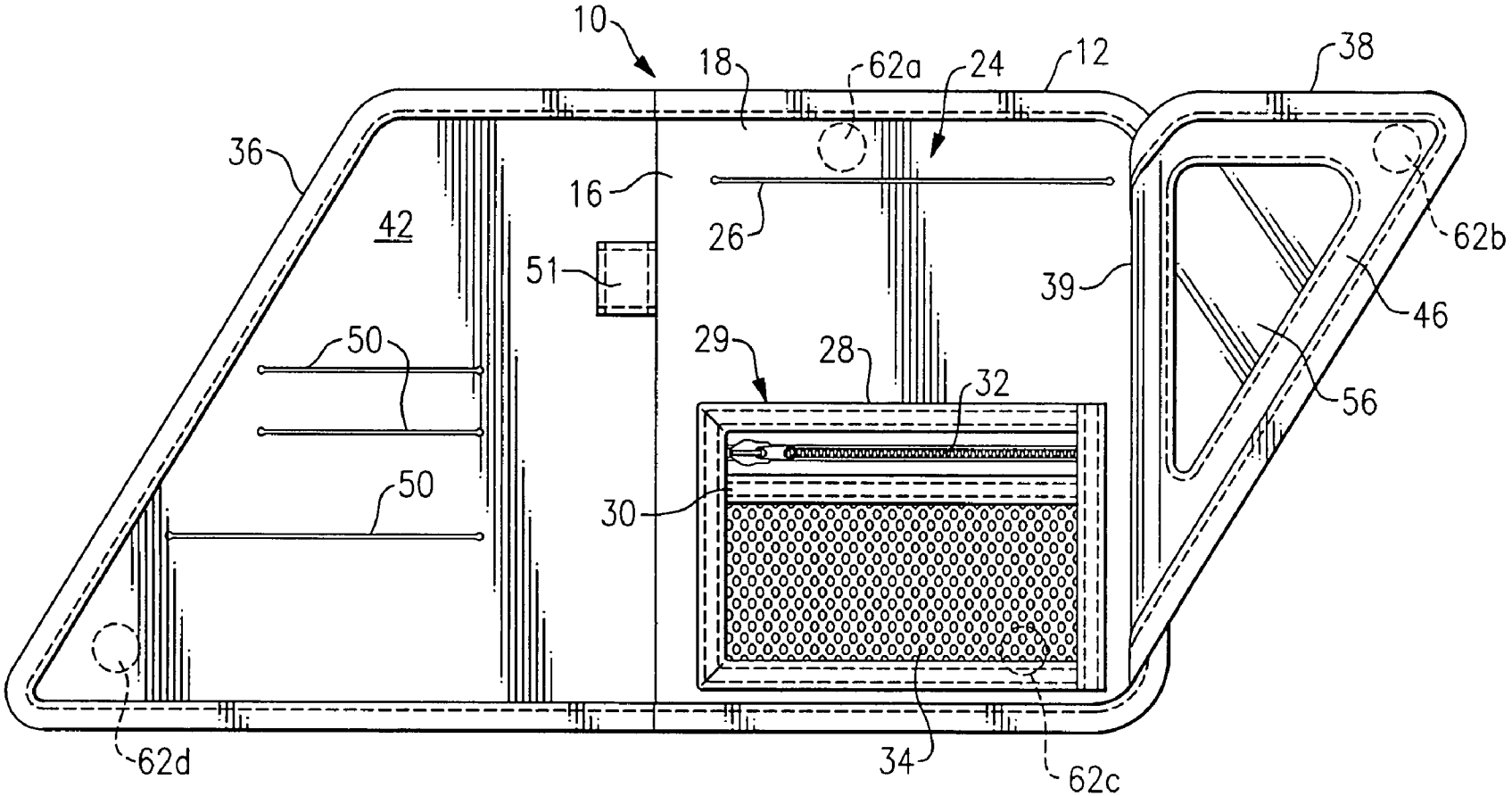
FIG. 5 is a front elevation view of the organizer cover of FIG. 1, shown with the first and the second flaps in open positions.

As best shown in FIG. 5, organizer cover 10 includes three organizer elements 26, 28 and 30, implemented on external surface 24. Element 26 is a slot contained in exterior surface 18 for receiving, e.g., a notepad 27 (FIG. 4). Element 28 is a pocket (interior not shown), and element 30 is a netted pouch. Pocket 28 contains an opening 29, suitable for receiving various small items. Pocket 28 is defined between exterior surface 18 and pouch 30. Pouch 30 includes a zipper closure 32 and a netted exterior wall 34. Pouch 30 is a general-purpose pouch, suitable for holding various small items such as coins 31 (FIG. 4).

An organizer element is an implementation of any organizer function, such as slot 26, pocket 28 or pouch 30. Other examples of organizer elements are: a mirror, card pocket, window or photograph pocket, pen/pencil loop, calculator or electronic organizer compartment, paper clip tray, and the like. Such organizer elements are typically located inside the organizer cover. In the present invention, such elements are relocated to external surface 24 of cover 10, for quick and easy access.

In accordance with the present invention, the externally located organizer elements are concealed by one or more concealment flaps. As shown in FIGS. 1 and 3–5, organizer cover 10 includes a concealment flap 36 and a concealment flap 38. Flaps 36 and 38 are each connected to cover 10 by being sewn at one end to cover 10. These sewn connections produce, in effect, a hinge that allows each flap to be manually positioned between an open position and a closed position. Flap 36 is sewn to rear panel 14 to establish a hinge 37 (See FIG. 2), and flap 38 is sewn to front panel 12 to establish a hinge 39 (See FIGS. 1 and 3).

As best shown in FIG. 1, flap 36 extends from hinge 37, around spine 16, and over a portion of front panel 12. FIGS. 1 and 3 show flap 36 in a closed position, and FIGS. 4 and 5 show flap 36 in an open position. In the closed position, flap 36 conceals a portion of organizer elements 26, 28 and 30, as best illustrated in FIG. 3. Flap 38 extends from hinge 39 over another (complementary) portion of front panel 12. FIGS. 1 and 4 show flap 38 in a closed position, and FIGS. 3 and 5 show flap 38 in an open position. In the closed position, flap 38 conceals a portion of organizer elements 26, 28 and 30, as best illustrated in FIG. 4. As shown in FIG. 1, flaps 36 and 38, together, substantially conceal organizer elements 26, 28 and 30. Flaps 36 and 38 are complementarily shaped so that they fit close together and provide substantially complete coverage or concealment of the organizer elements. In addition, the complementary shaped flaps present an aesthetically pleasing appearance.

Concealment flap 36 has exterior and interior surfaces 40 and 42, respectively, and concealment flap 38 has exterior and interior surfaces 44 and 46, respectively. As shown in FIGS. 1 and 3, flap 36 contains a storage pouch 48 having an opening through exterior surface 40. The opening includes a zipper closure 49. As shown in FIGS. 4 and 5, flap 36 contains a series of card pockets 50 and a pen loop 51 on interior surface 42. Pen loop 51 is strategically located adjacent to spine 16, where an annular space 52 (FIG. 1) is created between flap 36 and spine 16 (when flap 36 is in the closed position). Space 52 provides adequate clearance for a writing implement 53 inserted into loop 51, such that there is no significant deformation of flap 36 or spine 16 due to implement 53.

As shown in FIGS. 1 and 4, flap 38 contains a netted pocket 54 mounted on exterior surface 44. As shown in FIGS. 3 and 5, flap 38 contains a mirror 56 exposed through interior surface 46.

It is now understood that concealment flaps 36 and 38 also carry organizer elements (e.g., pouches, card pockets, mirrors, pen loops, etc.), which have been traditionally located inside the organizer cover. In the embodiment shown, two of the organizer elements (pouch 48 and pocket 54) are actually exposed to view on the exterior of flaps 36 and 38. However, these elements have a low profile, and thus do not detract from, and actually enhance, the aesthetics of cover 10.

As shown in FIG. 1, organizer cover 10 includes a general opening 58 and a zipper closure 60.

A concealment flap of the present invention (e.g., flaps 36 and 38) is defined as an external auxiliary flap that does not function as a closure to the general opening of the organizer cover. As shown in FIG. 1, neither flap 36 nor flap 38 extend over and around opening 58 to function as a closure.

As seen from FIGS. 3–5, neither the external surface 24 (including exteriors 18, 20 and 22) nor any organizer element (e.g., slot 26, pocket 28 or pouch 30) include thereon any means for securing concealment flaps 36, 38 in their closed positions. In addition, neither the external nor the internal surfaces of flaps 36, 38 include thereon any means for securing the flaps in their closed positions. This is done purposefully, in accordance with the present invention, to: (a) maximize the available surface area for organizer elements; (b) free the concealment flaps and organizer elements from any interference that may be caused by such securing means; and (c) enhance the aesthetics of the organizer cover by not displaying typically utilitarian securing means.

If it is desirable to provide some means for securing concealment flaps 36 and 38 in their closed positions, there are well-known methods of doing so. For example, the hinges for the flaps can be reinforced with resilient material which is biased to hold the flaps in their closed positions. Another example is the use of small diameter torsion springs embedded in the hinge to bias the flaps closed.

In the preferred embodiment, a novel approach is taken to secure the concealment flaps closed. A shown in FIGS. 3–5, magnetic discs 62 are mounted below the surfaces of front cover panel 12 and flaps 36 and 38. As shown in FIG. 3, a magnetic disc 62*a* is embedded below exterior surface 18 of panel 12 and a magnetic disc 62*b* is embedded below interior surface 46 of flap 38. Discs 62*a* and 62*b* are relatively positioned such that they are in registration when flap 38 is closed against panel 12, thus producing a magnetic attraction and connection of flap 38 against panel 12. Similarly, a magnetic disc 62*c* is embedded below surface 18 of panel 12, and a magnetic disc 62*d* is embedded below interior surface 42 of flap 36 (FIG. 4). Discs 62*c* and 62*d* are relatively positioned such that they are in registration when flap 36 is closed against panel 12, thus producing a magnetic attraction and connection of flap 36 against panel 12.

As indicated in FIGS. 3–5, discs 62*a*–62*d* are hidden from view and do not interfere with the aesthetics of cover 10 or with the function of organizer elements 26, 28 and 30 (and organizer elements 50, 51 and 56).

The principles of the present invention are especially applicable to compact hand-held organizers. A cover for such organizers would have dimensions of less than 8½ inches wide by 11 inches long, and more typically dimensions of less than 7 inches wide and 8 inches long.

While the preferred embodiment of the invention has been particularly described in the specification and illustrated in the drawing, it should be understood that the invention is not so limited. Many modifications, equivalents and adaptations of the invention will become apparent to those skilled in the art without departing from the spirit and scope of the invention, as defined in the appended claims.

What I claim is:

1. An organizer cover comprising:

first and second cover panels and a spine operatively coupled between said first and said second cover panels, said first cover panel having an exterior;

an organizer element located on the exterior of said first cover panel;

a first concealment flap extending from said second cover panel, around said spine, and over a first portion of said first cover panel, said first flap being manually positionable between a closed position against the exterior of said first cover panel and an open position, said first flap concealing at least a portion of said organizer element when said first flap is in the closed position; and a second concealment flap extending over a second portion of said first cover panel, said second flap being manually positionable between a closed position against the exterior of said first cover panel and an open position.

2. The organizer cover of claim 1, wherein said second concealment flap contains a mirror.

3. The organizer cover of claim 1, wherein the first and second portions constitute substantially the entire area of said first cover panel, and wherein said first and said second concealment flaps are complementarily shaped and fit close together when they are in their respective closed positions, such that said first cover panel and said organizer element are substantially concealed.

4. The organizer cover of claim 3, wherein said first concealment flap includes a proximal edge and a generally opposing distal edge, the proximal edge being affixed to said second cover panel to form a hinge for said first flap, the distal edge being free to allow said first flap to be positioned between the open and the closed positions, and wherein said second concealment flap includes a proximal edge and a generally opposing distal edge, the proximal edge being affixed to said first cover panel to form a hinge for said second flap, the distal edge being free to allow said second flap to be positioned between the open and the closed positions, the distal edge of said first flap fitting closely together in an opposing and complementary manner with the distal edge of said second flap when said first and said second flaps are in their respective closed positions.

5. The organizer cover of claim 1, wherein an annular space is defined between said spine and said first concealment flap when said first flap is in the closed position.

6. The organizer cover of claim 5, wherein said first concealment flap includes a pen loop located adjacent said spine, said pen loop being positioned within the annular space when said first flap is in the closed position.

7. The organizer cover of claim 1, wherein said first concealment flap contains a plurality of slots.

8. The organizer cover of claim 1, wherein said first concealment flap contains a pen loop.

9. The organizer cover of claim 1, wherein said first concealment flap contains a storage pouch.

10. The organizer cover of claim 1, wherein said organizer element is a pouch.

11. The organizer cover of claim 1, wherein said organizer element is at least one slot contained in said first cover panel.

* * * * *